US008975997B2

(12) United States Patent
Tonoyama et al.

(10) Patent No.: US 8,975,997 B2
(45) Date of Patent: Mar. 10, 2015

(54) PLANAR COIL ELEMENT

(71) Applicant: TDK Corporation, Tokyo (JP)

(72) Inventors: Kyohei Tonoyama, Tokyo (JP); Makoto Morita, Tokyo (JP); Tomokazu Ito, Tokyo (JP); Hitoshi Ohkubo, Tokyo (JP); Manabu Ohta, Tokyo (JP); Yoshihiro Maeda, Tokyo (JP); Yuuya Kaname, Tokyo (JP); Hideharu Moro, Tokyo (JP)

(73) Assignee: TDK Corporation, Tokyo (JP)

( * ) Notice: Subject to any disclaimer, the term of this patent is extended or adjusted under 35 U.S.C. 154(b) by 51 days.

(21) Appl. No.: 13/847,079

(22) Filed: Mar. 19, 2013

(65) Prior Publication Data

US 2013/0249662 A1 Sep. 26, 2013

(30) Foreign Application Priority Data

Mar. 26, 2012 (JP) ..... 2012-070011

(51) Int. Cl.

| | |
|---|---|
| ***H01F 5/00*** | (2006.01) |
| ***H01F 27/24*** | (2006.01) |
| ***H01F 27/28*** | (2006.01) |
| ***H01F 27/255*** | (2006.01) |
| ***H01F 17/00*** | (2006.01) |
| *H01F 27/29* | (2006.01) |
| *H01F 17/04* | (2006.01) |

(52) U.S. Cl.

CPC ..... *H01F 27/255* (2013.01); *H01F 17/0013* (2013.01); *H01F 27/292* (2013.01); *H01F 2017/048* (2013.01)

USPC ..... 336/200; 336/233; 336/234; 336/232

(58) Field of Classification Search

CPC . H01F 27/2804; H01F 41/046; H01F 41/041; H01F 17/0013; H01F 27/255; H01F 41/0246; B22F 2998/10; B22F 3/02; B22F 1/02

USPC ..... 336/200, 233, 232, 234

See application file for complete search history.

(56) References Cited

U.S. PATENT DOCUMENTS

| | | | | |
|---|---|---|---|---|
| 5,652,561 | A * | 7/1997 | Inoh et al. | 336/200 |
| 6,774,755 | B2 * | 8/2004 | Nakata et al. | 336/83 |
| 7,859,377 | B2 | 12/2010 | Kawarai | |
| 2004/0108929 | A1 * | 6/2004 | Ichikawa et al. | 336/83 |
| 2008/0100410 | A1 * | 5/2008 | Tomita et al. | 336/233 |
| 2009/0002117 | A1 * | 1/2009 | Kawarai | 336/233 |
| 2010/0289609 | A1 * | 11/2010 | Liao et al. | 336/221 |

* cited by examiner

FOREIGN PATENT DOCUMENTS

| | | | |
|---|---|---|---|
| JP | A-5-299232 | | 11/1993 |
| JP | A-2009-9985 | | 1/2009 |
| JP | 2011192729 | * | 3/2010 |
| JP | A-2011-192729 | | 9/2011 |

*Primary Examiner* — Elvin G Enad
*Assistant Examiner* — Kazi Hossain
(74) *Attorney, Agent, or Firm* — Oliff PLC

(57) ABSTRACT

In a planar coil element, the quantitative ratio of inclined particles to total particles of a first metal magnetic powder contained in a metal magnetic powder-containing resin provided in a through hole of a coil unit is higher than the quantitative ratio of inclined particles to total particles of the first metal magnetic powder contained in the metal magnetic powder-containing resin provided in other than the through hole, and many of particles of the first metal magnetic powder in the magnetic core are inclined particles whose major axes are inclined with respect to the thickness direction and the planar direction of a substrate. Therefore, the planar coil element has improved strength as compared to a planar coil element shown in FIG. 9A and has improved magnetic permeability as compared to a planar coil element shown in FIG. 9B.

6 Claims, 15 Drawing Sheets

(a)

(b)

| | AVERAGE ASPECT RATIO OF FIRST METAL MAGNETIC POWDER (AVERAGE PARTICLE SIZE: 32 μm) | SECOND METAL MAGNETIC POWDER | MAGNETIC PERMEABILITY (μ) |
|---|---|---|---|
| SAMPLE 1 | 1.2 | NONE | 24 |
| | 2.8 | | 28 |
| | 3.5 | | 25 |
| SAMPLE 2 | 1.2 | AVERAGE PARTICLE SIZE: 1 μm AVERAGE ASPECT RATIO:2.8 | 28 |
| | 2.8 | | 33 |
| | 3.5 | | 27 |
| SAMPLE 3 | 1.2 | AVERAGE PARTICLE SIZE: 1 μm AVERAGE ASPECT RATIO: 1.2 | 30 |
| | 2.8 | | 34 |
| | 3.5 | | 29 |

(a)

(b)

(a)

(b)

(a)

(b)

| | AVERAGE ASPECT RATIO OF FIRST METAL MAGNETIC POWDER (AVERAGE PARTICLE SIZE: 32 μm) | SECOND METAL MAGNETIC POWDER | MAGNETIC PERMEABILITY (μ) |
|---|---|---|---|
| SAMPLE 1 | 1.2 | NONE | 24 |
| | 2.8 | | 28 |
| | 3.5 | | 25 |
| SAMPLE 2 | 1.2 | AVERAGE PARTICLE SIZE: 1 μm AVERAGE ASPECT RATIO:2.8 | 28 |
| | 2.8 | | 33 |
| | 3.5 | | 27 |
| SAMPLE 3 | 1.2 | AVERAGE PARTICLE SIZE: 1 μm AVERAGE ASPECT RATIO: 1.2 | 30 |
| | 2.8 | | 34 |
| | 3.5 | | 29 |

(a)

(b)

| | AVERAGE ASPECT RATIO OF FIRST METAL MAGNETIC POWDER (AVERAGE PARTICLE SIZE: 21 μm) | SECOND METAL MAGNETIC POWDER | MAGNETIC PERMEABILITY (μ) |
|---|---|---|---|
| SAMPLE 4 | 1.2 | NONE | 21 |
| | 2.8 | | 24 |
| | 3.5 | | 22 |
| SAMPLE 5 | 1.2 | AVERAGE PARTICLE SIZE: 1 μm AVERAGE ASPECT RATIO:2.8 | 25 |
| | 2.8 | | 30 |
| | 3.5 | | 24 |
| SAMPLE 6 | 1.2 | AVERAGE PARTICLE SIZE: 1 μm AVERAGE ASPECT RATIO: 1.2 | 27 |
| | 2.8 | | 31 |
| | 3.5 | | 26 |

(a)

(b)

| | AVERAGE ASPECT RATIO OF FIRST METAL MAGNETIC POWDER (AVERAGE PARTICLE SIZE: 40 μm) | SECOND METAL MAGNETIC POWDER | MAGNETIC PERMEABILITY (μ) |
|---|---|---|---|
| SAMPLE 7 | 1.2 | NONE | 23 |
| | 2.8 | | 27 |
| | 3.5 | | 24 |
| SAMPLE 8 | 1.2 | AVERAGE PARTICLE SIZE: 1 μm AVERAGE ASPECT RATIO:2.8 | 27 |
| | 2.8 | | 30 |
| | 3.5 | | 26 |
| SAMPLE 9 | 1.2 | AVERAGE PARTICLE SIZE: 1 μm AVERAGE ASPECT RATIO: 1.2 | 27 |
| | 2.8 | | 31 |
| | 3.5 | | 26 |

(a)

(b)

| MIXING RATIO (WEIGHT RATIO) | 100/0 | 90/10 | 75/25 | 70/30 | 50/50 | 0/100 |
|---|---|---|---|---|---|---|
| MAGNETIC PERMEABILITY | 27 | 33 | 34 | 33 | 33 | 30 |

*Fig.15*

| | AVERAGE PARTICLE SIZE OF FIRST METAL MAGNETIC POWDER (μm) | AVERAGE PARTICLE SIZE OF SECOND METAL MAGNETIC POWDER (μm) | PARTICLE SIZE RATIO | MAGNETIC PERMEABILITY |
|---|---|---|---|---|
| SAMPLE A | 32 | 1 | 1/32 | 34 |
| SAMPLE B | 32 | 4 | 1/8 | 32 |
| SAMPLE C | 32 | 7 | 1/4.6 | 27 |

PLANAR COIL ELEMENT

BACKGROUND OF THE INVENTION

1. Field of the Invention

The present invention relates to a planar coil element.

2. Related Background Art

Surface mount-type planar coil elements are conventionally used in various electrical products such as household devices and industrial devices. In particular, small portable devices have come to be required to obtain two or more voltages from a single power source to drive individual devices due to enhanced functions. Therefore, surface mount-type planar coil elements are used also as power sources to satisfy such a requirement.

One of such planar coil elements is disclosed in, for example, Japanese Patent Application Laid-Open (JP-A) No. 2009-9985. The planar coil element disclosed in this document includes an air core coil formed in a spiral shape in a plane and a magnetic sheet stacked on the air core coil and containing an oblate or needle-like soft magnetic metal powder dispersed in a resin material. The above document discloses an embodiment in which the major axes of particles of the soft magnetic metal powder contained in the sheet stacked on the air core coil are oriented in the in-plane direction of the air core coil and the major axes of particles of the soft magnetic metal powder in the magnetic core of the air core coil are oriented in the in-plane direction of the air core coil or in a direction perpendicular to the plane of the air core coil.

However, the above-described planar coil element according to a conventional art has the following problem. That is, when the major axes of particles of the soft magnetic metal powder in the magnetic core of the air core coil are oriented in a direction perpendicular to the plane of the air core coil, the planar coil element is low in strength when subjected to the bending stress of an element-mounting substrate. On the other hand, when the major axes of particles of the soft magnetic metal powder in the magnetic core of the air core coil are oriented in the in-plane direction of the air core coil, the magnetic permeability of the magnetic core is low.

SUMMARY OF THE INVENTION

In order to solve the above problem, it is an object of the present invention to provide a planar coil element that achieves both high strength and high magnetic permeability.

The present invention is directed to a planar coil element including: a coil unit including a substrate and a conductor pattern for planar air core coil provided on the substrate, the coil unit having a through hole in a magnetic core; a metal magnetic powder-containing resin that integrally covers the coil unit on both surface sides of the substrate and fills the through hole of the coil unit; and an oblate or needle-like first metal magnetic powder contained in the metal magnetic powder-containing resin. A quantitative ratio of inclined particles, whose major axes are inclined with respect to a thickness direction and a planar direction of the substrate, to total particles of the first metal magnetic powder contained in the metal magnetic powder-containing resin provided in the through hole is higher than a quantitative ratio of inclined particles, whose major axes are inclined with respect to the thickness direction and the planar direction of the substrate, to total particles of the first metal magnetic powder contained in the metal magnetic powder-containing resin provided in other than the through hole.

In the planar coil element, the quantitative ratio of inclined particles to total particles of the first metal magnetic powder contained in the metal magnetic powder-containing resin in the through hole provided in the magnetic core of the coil unit is higher than the quantitative ratio of inclined particles to total particles of the first metal magnetic powder contained in the metal magnetic powder-containing resin provided in other than the through hole. Therefore, many of particles of the first metal magnetic powder in the magnetic core are inclined particles whose major axes are inclined with respect to the thickness direction and the planar direction of the substrate. Therefore, the planar coil element has improved strength as compared to when the major axes of particles of the first metal magnetic powder contained in the metal magnetic powder-containing resin provided in the through hole are oriented in the thickness direction of the substrate, and has improved magnetic permeability as compared to when the major axes of particles of the first metal magnetic powder contained in the metal magnetic powder-containing resin provided in the through hole are oriented in the planar direction of the substrate, and thus achieves both high order of strength and magnetic permeability.

The first metal magnetic powder may have an average aspect ratio of 2.0 to 3.2. In this case, high magnetic permeability can be achieved.

Further, the planar coil element may further include a second metal magnetic powder contained in the metal magnetic powder-containing resin and having an average particle size smaller than that of the first metal magnetic powder. In this case, particles of the second metal magnetic powder enter the gaps between particles of the first metal magnetic powder, which makes it possible to increase the amount of metal magnetic powder contained in the metal magnetic powder-containing resin and therefore to achieve high magnetic permeability.

Further, the metal magnetic powder-containing resin may contain the first metal magnetic powder and the second metal magnetic powder in an amount of 90 to 98 wt %. In this case, adequate strength can be ensured while high magnetic permeability is achieved.

Further, a mixing ratio by weight between the first metal magnetic powder and the second metal magnetic powder may be 90/10 to 50/50. In this case, particles of the second metal magnetic powder significantly enter the gaps between particles of the first metal magnetic powder so that high magnetic permeability is achieved.

Further, a ratio of the average particle size of the second metal magnetic powder to the average particle size of the first metal magnetic powder may be 1/32 to 1/8. The use of the second metal magnetic powder having a small average particle size makes it possible to achieve high magnetic permeability.

According to the present invention, it is possible to provide a planar coil element that achieves both high strength and high magnetic permeability.

BRIEF DESCRIPTION OF THE DRAWINGS

FIG. 15 is a table showing the results of an experiment on the average particle size ratio between a first metal magnetic powder and a second metal magnetic powder.

DESCRIPTION OF THE PREFERRED EMBODIMENTS

Figure 1:
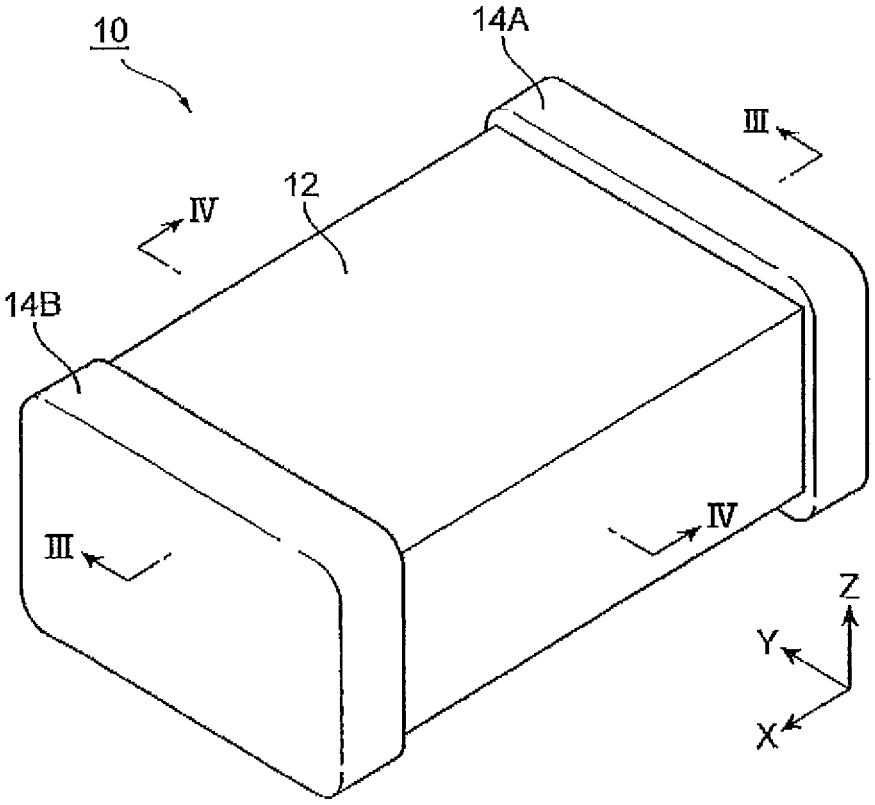
FIG. 1 is a schematic perspective view of a planar coil element according to an embodiment of the present invention.
Figure 2:
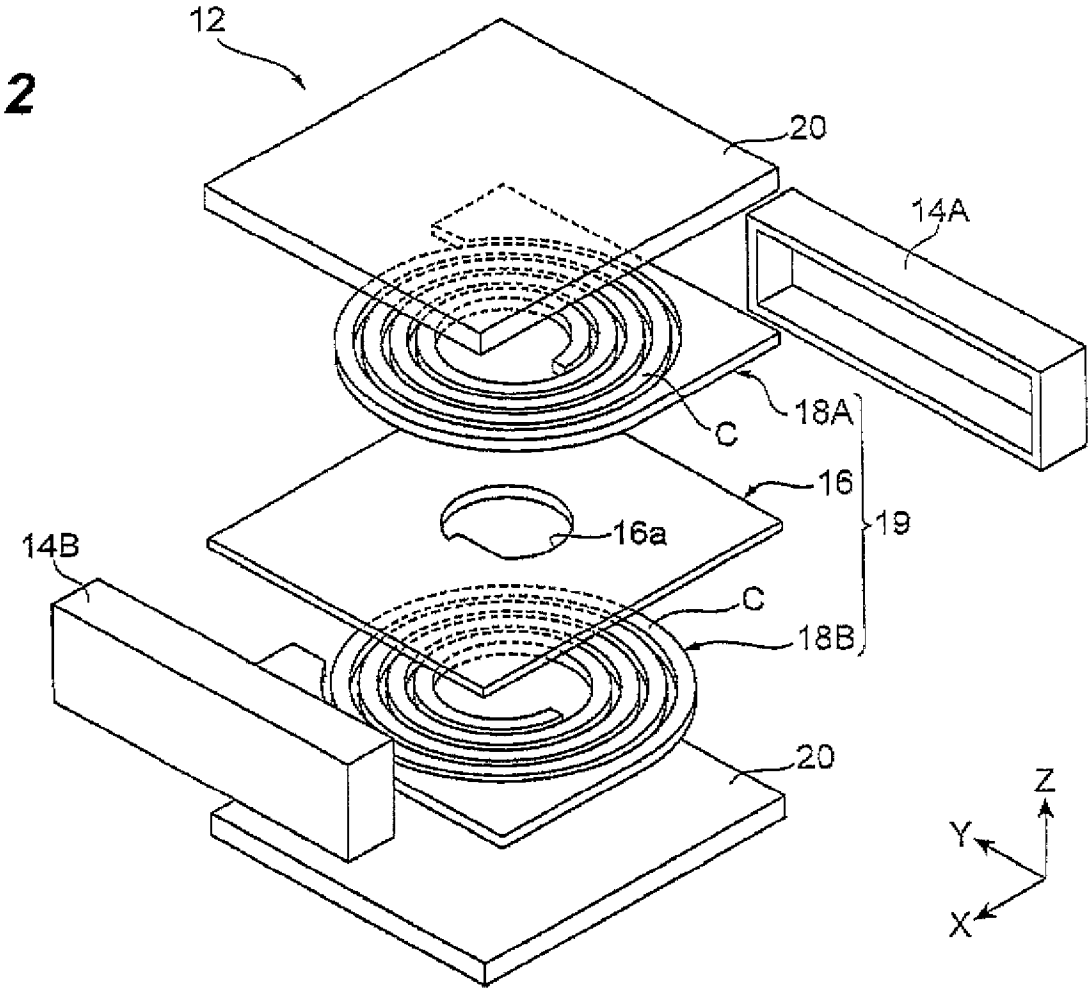
FIG. 2 is an exploded view of the planar coil element shown in FIG. 1.
Figure 3:
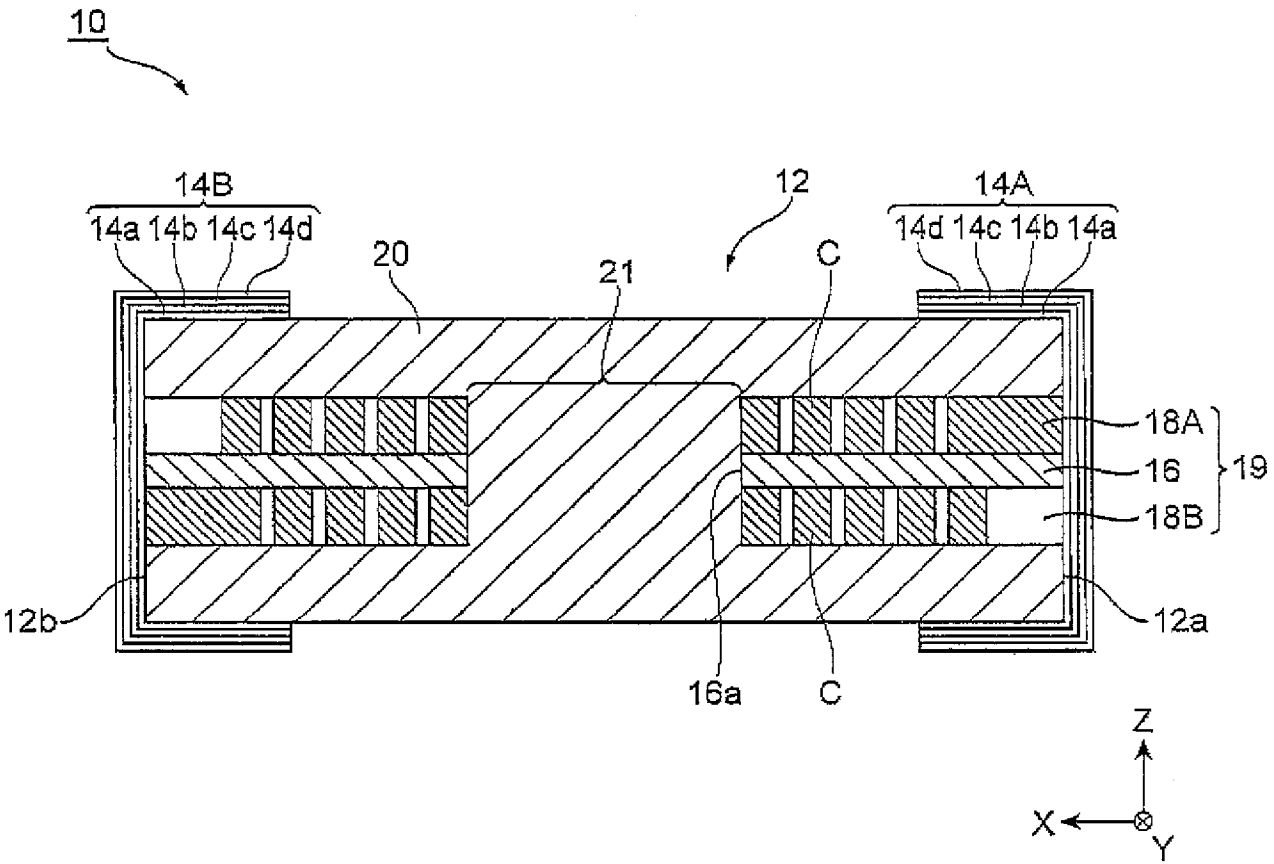
FIG. 3 is a sectional view of the planar coil element taken along a line III-III in FIG. 1.
Figure 4:
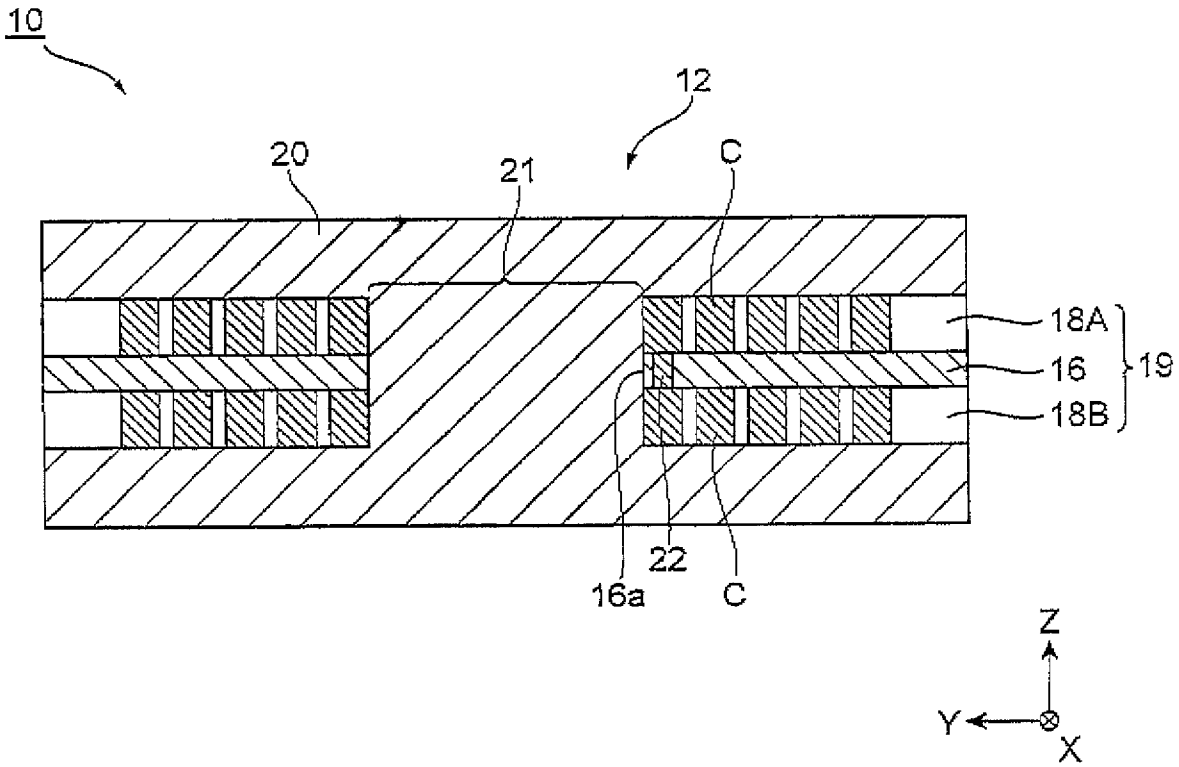
FIG. 4 is a sectional view of the planar coil element taken along a line IV-IV in FIG. 1.

Hereinbelow, a preferred embodiment of the present invention will be described in detail with reference to the accompanying drawings. It is to be noted that in the following description, the same elements or elements having the same function are represented by the same reference numerals and description thereof will not be repeated.

First, the structure of a planar coil element according to an embodiment of the present invention will be described with reference to FIGS. 1 to 4. For convenience of description, as shown in the drawings, X-, Y-, and Z-coordinates are set. More specifically, the thickness direction of the planar coil element is defined as a Z direction, a direction in which external terminal electrodes are opposed to each other is defined as an X direction, and a direction orthogonal to the X direction and the Z direction is defined as a Y direction.

A planar coil element 10 includes a main body 12 having a rectangular parallelepiped shape and a pair of external terminal electrodes 14A and 14B provided to cover a pair of opposing end faces 12*a* and 12*b* of the main body 12. The planar coil element 10 is designed to have, for example, a long side of 2.5 mm, a short side of 2.0 mm, and a height of 0.8 to 1.0 mm.

The main body 12 has a coil unit 19 having a substrate 16 and conductor patterns 18A and 18B for planar air core coil which are provided on both upper and lower sides of the substrate 16.

The substrate 16 is a plate-like rectangular member made of a non-magnetic insulating material. In the central part of the substrate 16, an approximately-circular opening 16*a* is provided. As the substrate 16, a substrate obtained by impregnating a glass cloth with a cyanate resin (BT (bismaleimide triazine) resin: trademark) and having a thickness of 60 μm can be used. It is to be noted that polyimide, aramid, or the like may be used instead of BT resin. As a material of the substrate 16, ceramics or glass may also be used. Preferred examples of material of the substrate 16 include mass-produced printed circuit board materials, and particularly, resin materials used for BT printed circuit boards, FR4 printed circuit boards, or FR5 printed circuit boards are most preferred.

Both the conductor patters 18A and 18B are planar spiral patterns constituting a planar air core coil and are formed by plating with a conductive material such as Cu. It is to be noted that the surfaces of the conductor patterns 18A and 18B are coated with an insulating resin (not shown). A winding wire C of the conductor patterns 18A and 18B has, for example, a height of 80 to 120 μm, a width of 70 to 85 μm, and a winding pitch of 10 to 15 μm.

The conductor pattern 18A is provided on the upper surface of the substrate 16, and the conductor pattern 18B is provided on the lower surface of the substrate 16. The conductor patterns 18A and 18B are almost superimposed with the substrate 16 being interposed therebetween, and both of them are provided to surround the opening 16*a* of the substrate 16. Therefore, a through hole (magnetic core 21) is provided in the coil unit 19 by the opening 16*a* of the substrate 16 and the air cores of the conductor patterns 18A and 18B.

The conductor pattern 18A and the conductor pattern 18B are electrically connected to each other by a via-hole conductor 22 provided to penetrate through the substrate 16 near the magnetic core 21 (i.e., near the opening 16*a*). Further, the conductor pattern 18A provided on the upper surface of the substrate spirals outwardly in a counterclockwise direction when viewed from the upper surface side, and the conductor pattern 18B provided on the lower surface of the substrate spirals outwardly in a counterclockwise direction when viewed from the lower surface side, which makes it possible to pass an electrical current through the conductor patterns 18A and 18B connected by the via-hole conductor 22 in a single direction. When an electrical current is passed through the conductor patterns 18A and 18B in a single direction, a direction in which the electrical current passing through the conductor pattern 18A rotates and a direction in which the electrical current passing through the conductor pattern 18B rotates are the same, and therefore magnetic fluxes generated by both the conductor patterns 18A and 18B are superimposed and enhance each other Further, the main body 12 has a metal magnetic powder-containing resin 20 enclosing the coil unit 19. As a resin material of the metal magnetic powder-containing resin 20, for example, a thermosetting epoxy resin is used. The metal magnetic powder-containing resin 20 integrally covers the conductor pattern 18A and the upper surface of the substrate 16 on the upper side of the coil unit 19 and integrally covers the conductor pattern 18B and the lower surface of the substrate 16 on the lower side of the coil unit 19. Further, the metal magnetic powder-containing resin 20 also fills the through hole provided in the coil unit 19 as the magnetic core 21.

Figure 5:
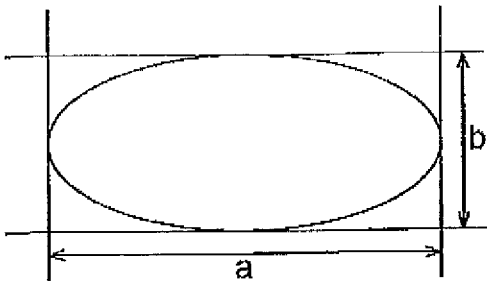
FIG. 5 is a diagram for explaining the aspect ratio of a metal magnetic powder.

In the metal magnetic powder-containing resin 20, a first metal magnetic powder 30 is dispersed. The first metal magnetic powder 30 has an oblate shape. The first metal magnetic powder 30 is made of, for example, an iron-nickel alloy (permalloy). The average particle size of the first metal magnetic powder 30 is about 32 μm. As shown in FIG. 5, when the lengths of major and minor axes are defined as a and b, respectively, the average aspect ratio (a/b) of the first metal magnetic powder is in the range of 2.0 to 3.2. It is to be noted that the first metal magnetic powder 30 may have a needle-like shape.

Further, in the metal magnetic powder-containing resin 20, an approximately-spherical metal magnetic powder is uniformly dispersed as a second metal magnetic powder 32 in addition to the first metal magnetic powder 30. The second metal magnetic powder 32 is made of, for example, carbonyl iron. The second metal magnetic powder 32 has an average particle size of about 1 μm and an aspect ratio (a/b) of 1.0 to 1.5. The average particle size of the second metal magnetic powder 32 is preferably smaller from the viewpoint of magnetic permeability, but a metal magnetic powder having an average particle size smaller than 1 μm is very hard to obtain due to cost problems and the like.

The metal magnetic powder-containing resin 20 is designed so that the amount of the first metal magnetic powder 30 and the second metal magnetic powder 32 contained therein is in the range of 90 to 98 wt %. Further, the metal magnetic powder-containing resin 20 is designed so that the mixing ratio by weight between the first metal magnetic powder 30 and the second metal magnetic powder 32 is in the range of 90/10 to 50/50.

The pair of external terminal electrodes 14A and 14B are electrodes are connected to the above-described conductor patterns 18A and 18B, and are configured to be connected to the circuit of an element-mounting substrate. More specifically, the external terminal electrode 14A that covers the end face 12*a* of the main body 12 is connected to the end of the conductor pattern 18A exposed at the end face 12*a*, and the external terminal electrode 14B that covers the end face 12*b* opposed to the end face 12*a* is connected to the end of the conductor pattern 18B exposed at the end face 12*b*. Therefore, when a voltage is applied between the external terminal electrodes 14A and 14B, for example, an electrical current flowing from the conductor pattern 18A to the conductor pattern 18B is generated.

Each of the external terminal electrodes 14A and 14B has a four-layer structure including, in order of increasing distance from the main body 12, a Cr sputtered layer 14*a*, a Cu sputtered layer 14*b*, a Ni plated layer 14*c*, and a Sn plated layer 14*d*.

Figure 6:
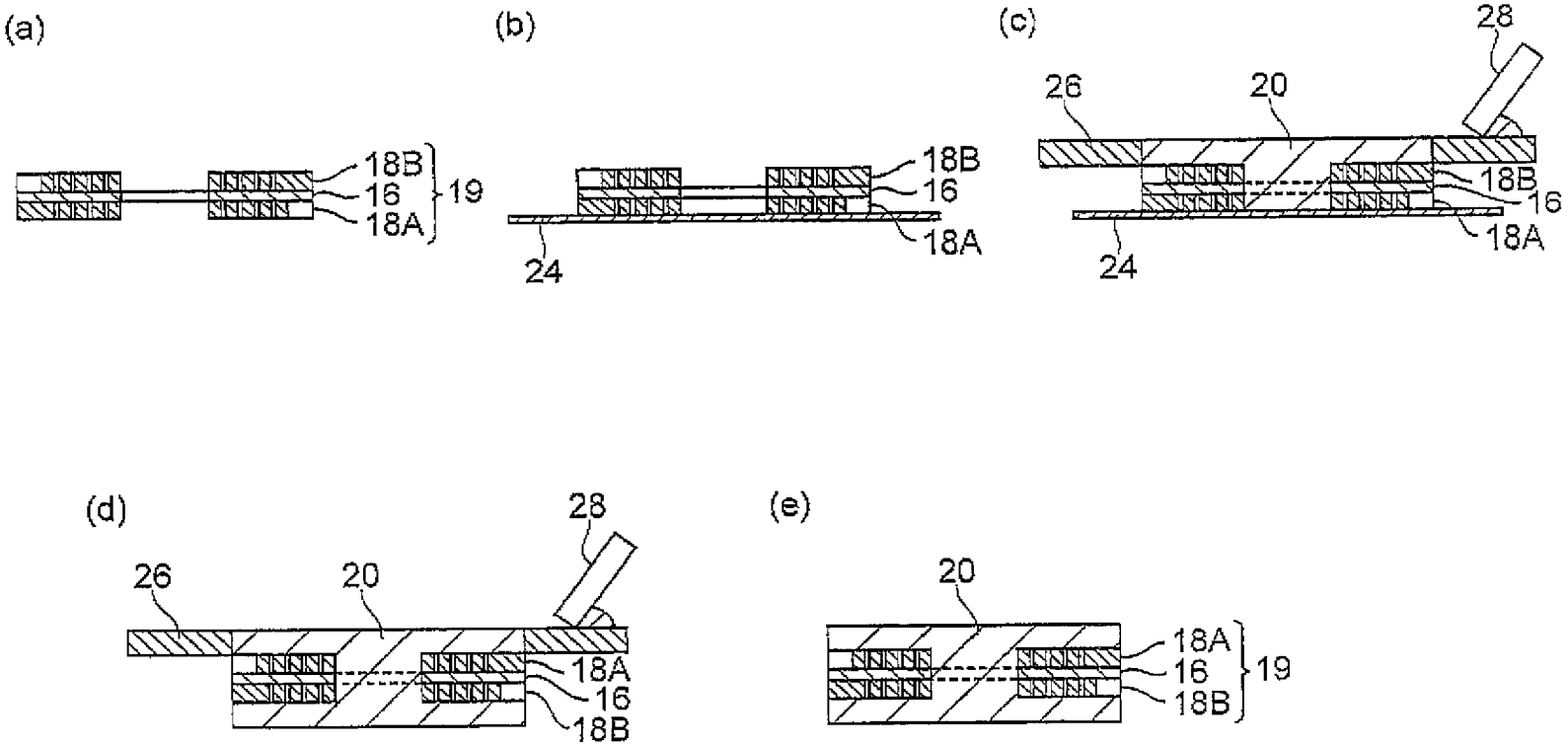
FIGS. 6A to 6E are diagrams illustrating the production steps of the planar coil element shown in FIG. 1.

Hereinbelow, the procedure of producing the above-described planar coil element 10 will be described with reference to FIG. 6.

In order to produce the planar coil element 10, the coil unit 19, in which the conductor patterns 18A and 18B are formed by plating on the upper and lower sides of the substrate 16, is first prepared (see FIG. 6A). The plating may be performed by a well-known plating method. When an electrolytic plating method is used to form the conductor patterns 18A and 18B, a foundation layer needs to be previously formed by non-electrolytic plating. It is to be noted that the conductor pattern may be subjected to surface roughening treatment to have surface irregularities or to oxidation treatment to have an oxide film in order to improve adhesive strength between the conductor pattern and the metal magnetic powder-containing resin 20 or to allow the metal magnetic powder-containing resin paste 20 to easily enter the spaces between adjacent turns of the winding wire C.

Then, the coil unit 19 is fixed onto a UV tape 24 (see FIG. 6B). It is to be noted that the UV tape 24 is intended to suppress the warpage of the substrate 16 during subsequent treatment.

Then, the above-described metal magnetic powder-containing resin paste 20 containing the first metal magnetic powder 30 and the second metal magnetic powder 32 dispersed therein is prepared, and is applied onto the coil unit 19 fixed with the UV tape 24 by screen printing using a mask 26 and a squeegee 28 (see FIG. 6C). This makes it possible to integrally cover the conductor pattern 18B-side surface of the substrate 16 with the metal magnetic powder-containing resin paste 20 as well as to fill the through hole in the magnetic core 21 with the metal magnetic powder-containing resin 20. After the application of the metal magnetic powder-containing resin paste 20, predetermined curing treatment is performed.

Then, the coil unit 19 is turned upside down and the UV tape 24 is removed, and the metal magnetic powder-containing resin paste 20 is again applied by screen printing (see FIG. 6D). This makes it possible to integrally cover the conductor pattern 18A-side surface of the substrate 16 with the metal magnetic powder-containing resin paste 20. After the application of the metal magnetic powder-containing resin paste 20, predetermined curing treatment is performed.

Then, dicing is performed to obtain a predetermined size (see FIG. 6D). Finally, the external terminal electrodes 14A and 14B are formed by sputtering and plating to complete the production of the planar coil element 10.

Figure 7:
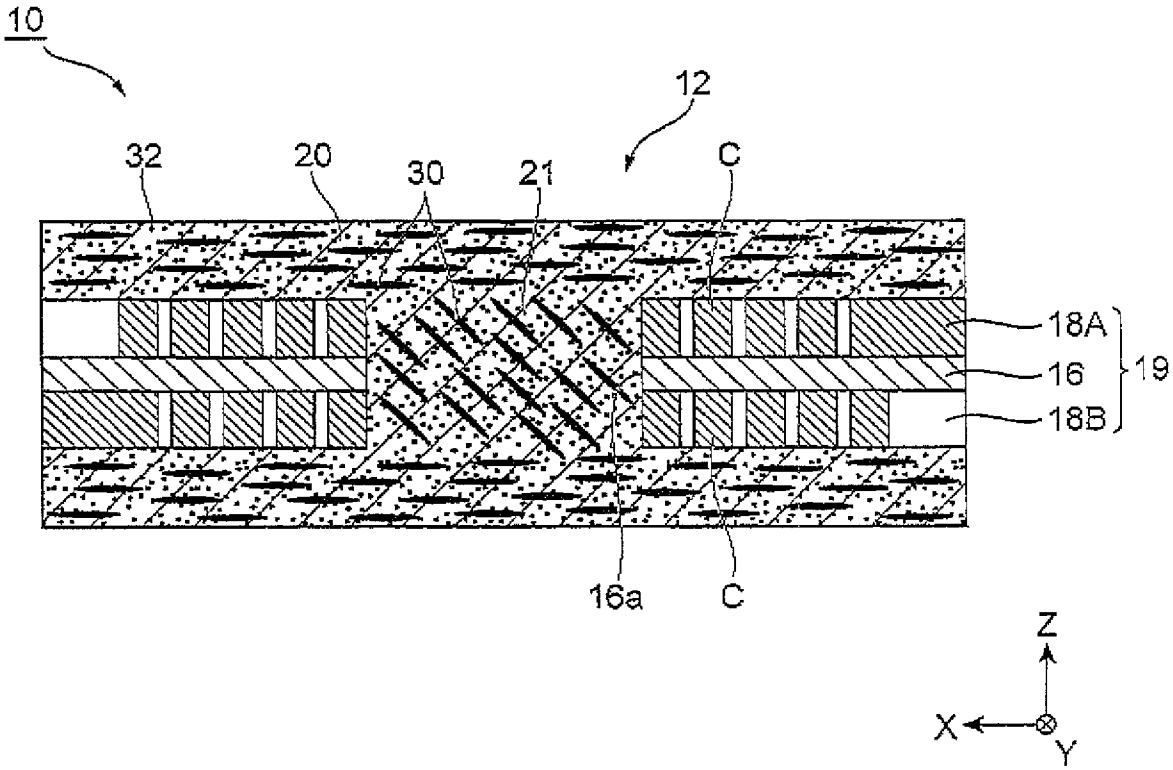
FIG. 7 is a diagram illustrating the orientation of particles of the metal magnetic powder in the planar coil element shown in FIG. 1.

Hereinbelow, the state of the first metal magnetic powder 30 and the second metal magnetic powder 32 contained in the metal magnetic powder-containing resin 20 will be described with reference to FIG. 7.

The major axes of many of particles of the first metal magnetic powder 30 contained in the metal magnetic powder-containing resin 20 located on the upper and lower sides of the coil unit 19 are oriented in the planar direction (direction in the X-Y plane) of the substrate 16. This is because the metal magnetic powder-containing resin 20 located in such positions flows in the planar direction during the above-described screen printing, and therefore the major axes of particles of the first metal magnetic powder 30 are oriented in a direction in which the metal magnetic powder-containing resin 20 flows.

Further, many of particles of the first metal magnetic powder 30 contained in the metal magnetic powder-containing resin 20 located in the magnetic core 21 of the coil unit 19 are inclined particles whose major axes are inclined with respect to the thickness direction (Z direction) and the planar direction (direction in the X-Y plane) of the substrate 16. This is because when the metal magnetic powder-containing resin 20 enters the magnetic core 21 of the coil unit 19 during the above-described screen printing, a direction in which the metal magnetic powder-containing resin 20 enters the magnetic core 21 is not completely parallel with the thickness direction so that the major axes of particles of the first metal magnetic powder 30 contained in the metal magnetic powder-containing resin 20 located in such a position are inclined toward a print direction (i.e., toward a direction in which the squeegee 28 is moved) and are therefore oriented in an obliquely downward direction (in FIG. 7, in a lower right direction).

Figure 8:
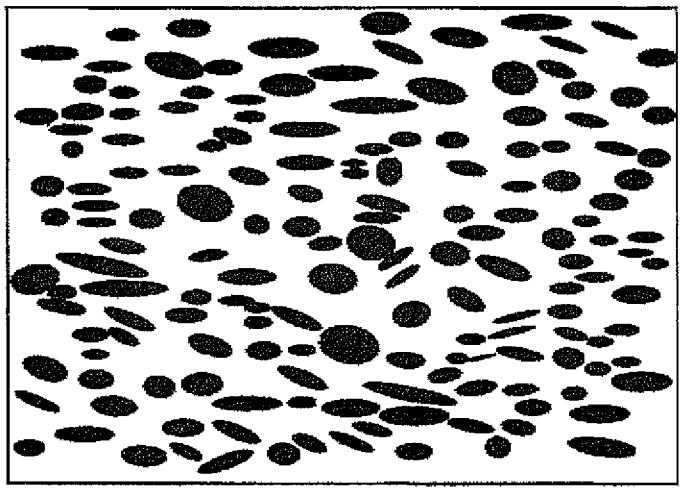
FIG. 8A is a schematic diagram illustrating a state in which particles of a first metal magnetic powder are oriented in a metal magnetic powder-containing resin located on the upper and lower sides of a coil unit and FIG. 8B is a schematic diagram illustrating a state in which particles of the first metal magnetic powder are oriented in the metal magnetic powder-containing resin located in a magnetic core of the coil unit.
Figure 8:
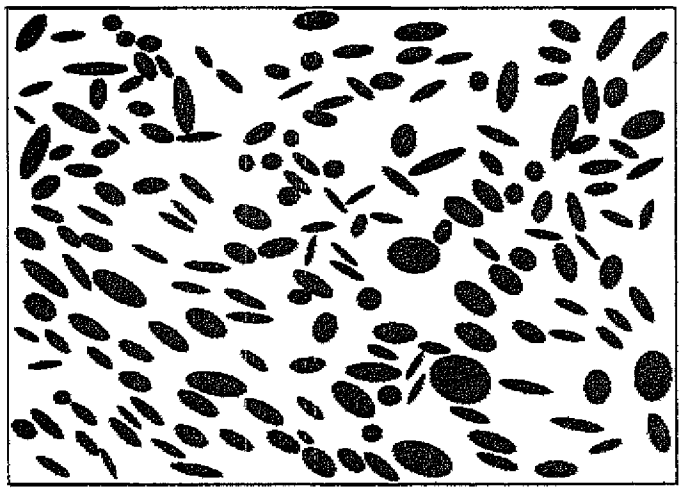

It is to be noted that the state in which the first metal magnetic powder is oriented in the metal magnetic powder-containing resin 20 located on the upper and lower sides of the coil unit 19 may include a state in which, as shown in a schematic diagram of FIG. 8A, not all the particles of the first metal magnetic powder are oriented in the planar direction of the substrate 16 and some of them are inclined with respect to the thickness direction and the planar direction of the substrate 16. Further, the state in which the first metal magnetic powder is oriented in the metal magnetic powder-containing resin 20 located in the magnetic core 21 of the coil unit 19 may include a state in which, as shown in a schematic diagram of FIG. 8B, not all the particles of the first metal magnetic powder are inclined with respect to the thickness direction and the planar direction of the substrate 16 and some of them are oriented in the thickness direction or the planar direction of the substrate 16. However, in the planar coil element 10, the quantitative ratio of inclined particles, which are inclined with respect to the thickness direction and the planar direction of the substrate 16, to total particles of the first metal magnetic powder contained in the metal magnetic powder-containing resin 20 located in the magnetic core 21 of the coil unit 19 needs to be higher than the quantitative ratio of inclined particles, which are inclined with respect to the thickness direction and the planar direction of the substrate 16, to total particles of the first metal magnetic powder contained in the metal magnetic powder-containing resin 20 located on the upper and lower sides of the coil unit 19.

The second metal magnetic powder 32 is uniformly dispersed in the metal magnetic powder-containing resin 20. As described above, since the average particle size of the second metal magnetic powder 32 is much smaller than that of the first metal magnetic powder 30 (average particle size ratio=1/32), particles of the second metal magnetic powder 32 can easily enter the gaps between large particles of the first metal magnetic powder 30.

In this way, the filling factor of metal magnetic powder in the metal magnetic powder-containing resin 20 can be increased by using the first metal magnetic powder 30 and the second metal magnetic powder 32 different in average particle size, which makes it possible to achieve high magnetic permeability. Further, the use of a metal magnetic material makes it possible to obtain a planar coil element superior in direct-current superimposing characteristics as compared to when, for example, ferrite is used.

Figure 9:
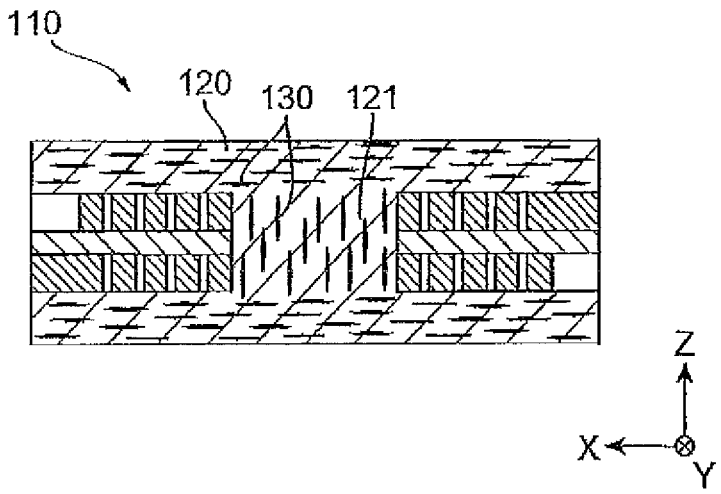
FIGS. 9A and 9B are diagrams illustrating the orientation of particles of a metal magnetic powder according to a conventional art.
Figure 9:
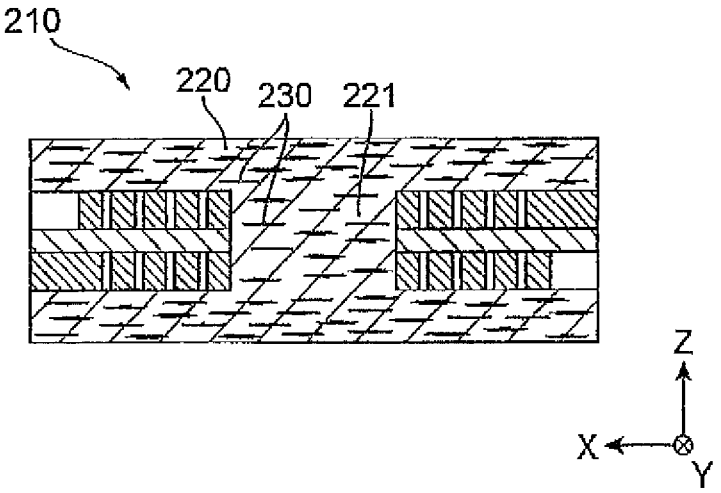

In the case of a planar coil element 110 shown in FIG. 9A in which a first metal magnetic powder 130 is contained in a metal magnetic powder-containing resin 120 provided in a magnetic core 121 in such a manner that the major axes of particles of the first metal magnetic powder 130 are oriented in the thickness direction (Z direction) of a substrate, there is a case where the planar coil element 110 is weak against external force such as the bending stress of an element-mounting substrate and cannot have adequate strength.

Further, in the case of a planar coil element 210 shown in FIG. 9B in which a first metal magnetic powder 230 is contained in a metal magnetic powder-containing resin 220 provided in a magnetic core 221 in such a manner that the major axes of particles of the first metal magnetic powder 230 are oriented in the planar direction (direction in the X-Y plane) of a substrate, there is a case where the planar coil element 210 cannot have adequate magnetic permeability in the magnetic core 221 because the first metal magnetic powder 230 interferes with a magnetic flux in the magnetic core 221.

On the other hand, in the planar coil element 10, the quantitative ratio of inclined particles to total particles of the first metal magnetic powder 30 contained in the metal magnetic powder-containing resin 20 provided in the magnetic core 21 of the coil unit 19 is higher than the quantitative ratio of inclined particles to total particles of the first metal magnetic powder 30 contained in the metal magnetic powder-containing resin 20 provided in other than the magnetic core 21, and many of particles of the first metal magnetic powder 30 in the magnetic core 21 are inclined particles whose major axes are inclined with respect to the thickness direction and the planar direction of the substrate 16. Therefore, the planar coil element 10 has improved strength as compared to the planar coil element 110 shown in FIG. 9A, and has improved magnetic permeability as compared to the planar coil element 210 shown in FIG. 9B, and thus achieves both high-order of strength and magnetic permeability.

Figure 10:
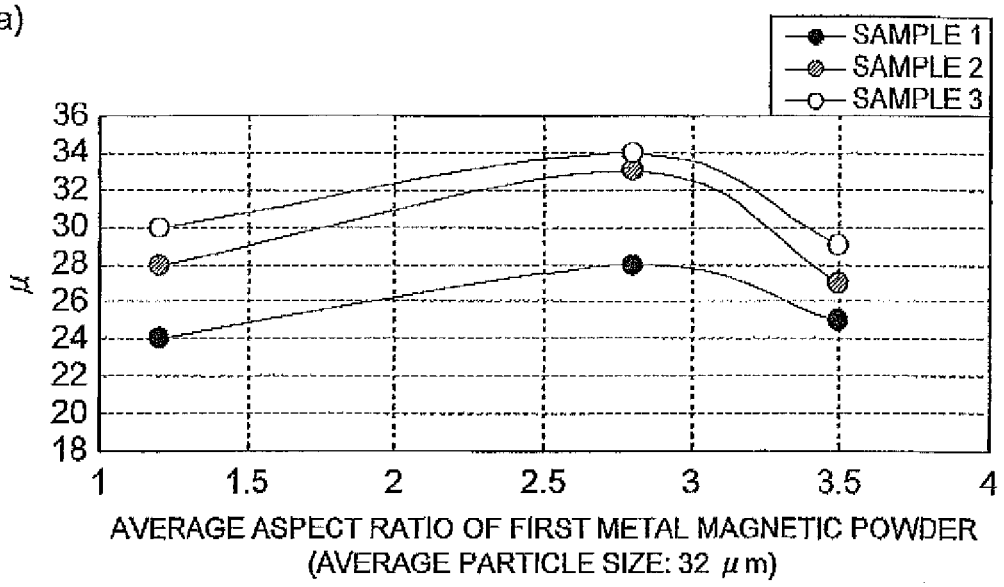
FIGS. 10A and 10B are a graph and a table showing the results of an experiment on average aspect ratio, respectively.

(Average Aspect Ratio) FIG. 10 shows the results of an experiment performed by the present inventors to determine an appropriate average aspect ratio of the first metal magnetic powder 30. In this experiment, three kinds of samples containing a first metal magnetic powder (permalloy) having an average particle size of 32 μm were prepared, and the magnetic permeability μ of each of the samples was measured by changing the average aspect ratio of the first metal magnetic powder (three average aspect ratios: 1.2, 2.8, and 3.5).

The three kinds of samples were as follows: Sample 1 containing only the first metal magnetic powder; Sample 2 containing the first metal magnetic powder and a second metal magnetic powder (carbonyl iron) having an average particle size of 1 μm and an average aspect ratio of 2.8; and Sample 3 containing the first metal magnetic powder and a second metal magnetic powder (carbonyl iron) having an average particle size of 1 μm and an average aspect ratio of 1.2. In the cases of all the samples, the amount of metal magnetic powder contained in the metal magnetic powder-containing resin was set to 97 wt %. It is to be noted that in the cases of Samples 2 and 3, the mixing ratio by weight between the first metal magnetic powder and the second metal magnetic powder was set to 75/25.

FIG. 10A is a graph showing the measurement results, in which a horizontal axis represents the average aspect ratio of the first metal magnetic powder and a vertical axis represents the magnetic permeability μ. FIG. 10B shows the measurement results in tabular form.

As is clear from the graph shown in FIG. 10A, all the samples have a peak magnetic permeability μ when the average aspect ratio of the first metal magnetic powder is about 2.8, from which it is found that high magnetic permeability (equal to or higher than 90% of the peak) is achieved when the average aspect ratio is in the range of 2.0 to 3.2.

Figure 11:
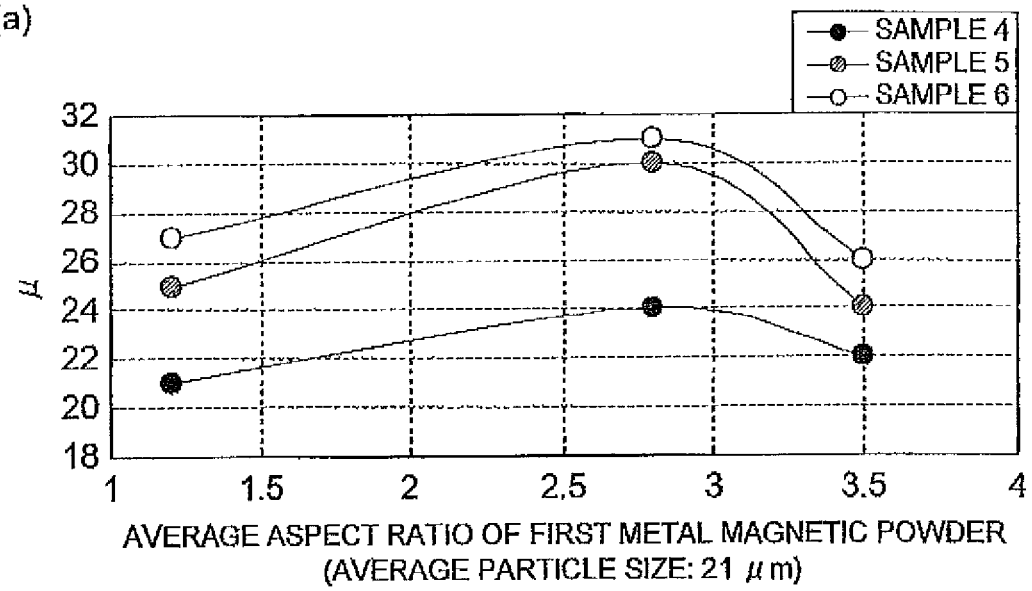
FIGS. 11A and 11B are a graph and a table showing the results of an experiment on average aspect ratio, respectively.

FIG. 11 shows the results of an experiment performed in the same manner as described above except that the average particle size of the first metal magnetic powder 30 was changed to 21 μm. More specifically, three kinds of samples containing a first metal magnetic powder (permalloy) having an average particle size of 21 μm were prepared and the magnetic permeability μ of each of the samples was measured by changing the average aspect ratio of the first metal magnetic powder (three average aspect ratios: 1.2, 2.8, and 3.5).

The three kinds of samples were as follows: Sample 4 containing only the first metal magnetic powder; Sample 5 containing the first metal magnetic powder and a second metal magnetic powder (carbonyl iron) having an average particle size of 1 μm and an average aspect ratio of 2.8; and Sample 6 containing the first metal magnetic powder and a second metal magnetic powder (carbonyl iron) having an average particle size of 1 μm and an average aspect ratio of 1.2. In the cases of all the samples, the amount of metal magnetic powder contained in the metal magnetic powder-containing resin was set to 97 wt %. It is to be noted that in the cases of Samples 5 and 6, the mixing ratio by weight between the first metal magnetic powder and the second metal magnetic powder was set to 75/25.

FIG. 11A is a graph showing the measurement results, in which a horizontal axis represents the average aspect ratio of the first metal magnetic powder and a vertical axis represents the magnetic permeability μ. FIG. 11B shows the measurement results in tabular form.

As is clear from the graph shown in FIG. 11A, all the samples have the maximum magnetic permeability μ when the average aspect ratio of the first metal magnetic powder is about 2.8, from which it is found that high magnetic permeability is achieved when the average aspect ratio is in the range of 2.0 to 3.2.

Figure 12:
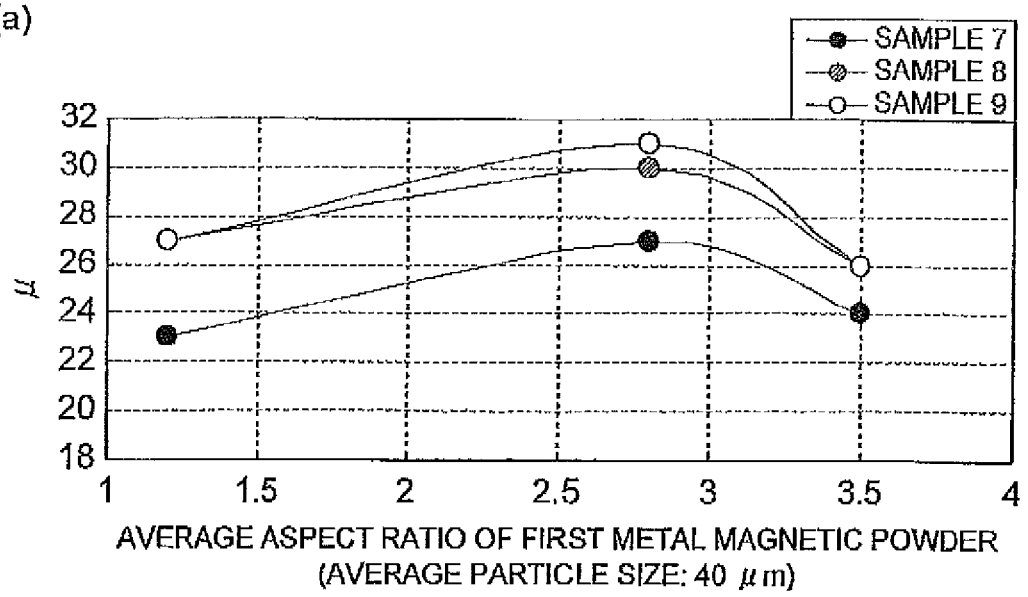
FIGS. 12A and 12B are a graph and a table showing the results of an experiment on average aspect ratio, respectively.

FIG. 12 shows the results of an experiment performed in the same manner as described above except that the average particle size of the first metal magnetic powder 30 was changed to 40 μm. More specifically, three kinds of samples containing a first metal magnetic powder (permalloy) having an average particle size of 40 μm were prepared and the magnetic permeability μ of each of the samples was measured by changing the average aspect ratio of the first metal magnetic powder (three average aspect ratios: 1.2, 2.8, and 3.5).

The three kinds of samples were as follows: Sample 7 containing only the first metal magnetic powder; Sample 8 containing the first metal magnetic powder and a second metal magnetic powder (carbonyl iron) having an average particle size of 1 μm and an average aspect ratio of 2.8; and Sample 9 containing the first metal magnetic powder and a second metal magnetic powder (carbonyl iron) having an average particle size of 1 μm and an average aspect ratio of 1.2. In the cases of all the samples, the amount of metal magnetic powder contained in the metal magnetic powder-containing resin was set to 97 wt %. It is to be noted that in the cases of Samples 8 and 9, the mixing ratio by weight between the first metal magnetic powder and the second metal magnetic powder was set to 75/25.

FIG. 12A is a graph showing the measurement results, in which a horizontal axis represents the average aspect ratio of the first metal magnetic powder and a vertical axis represents the magnetic permeability μ. FIG. 12B shows the measurement results in tabular form.

As is clear from the graph shown in FIG. 12A, all the samples have the maximum magnetic permeability μ when the average aspect ratio of the first metal magnetic powder is about 2.8, from which it is found that high magnetic permeability is achieved when the average aspect ratio is in the range of 2.0 to 3.2.

It has been found from the above experimental results that high magnetic permeability is achieved when the average aspect ratio is in the range of 2.0 to 3.2 whether the average particle size of the first metal magnetic powder 30 is large or small. Therefore, from the viewpoint of magnetic permeability, the average aspect ratio of the first metal magnetic powder 30 used in the planar coil element 10 is set to a value in the range of 2.0 to 3.2.

Figure 13:
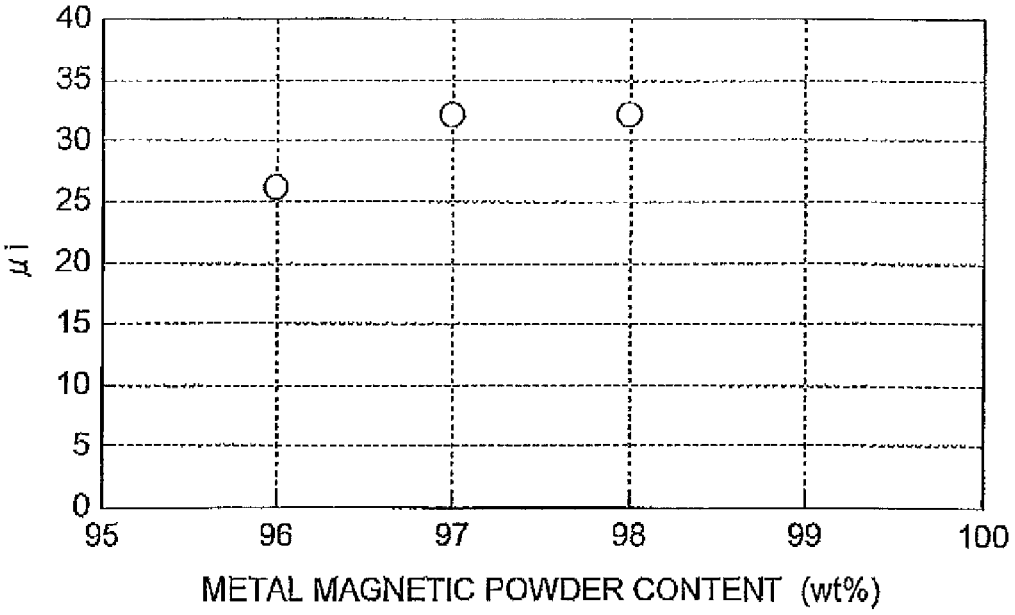
FIG. 13 is a graph showing the results of an experiment on metal magnetic powder content.

(Metal Magnetic Powder Content) FIG. 13 shows the results of an experiment performed by the present inventors to determine an appropriate metal magnetic powder content. In this experiment, three kinds of samples different in metal magnetic powder content (96 wt %, 97 wt %, and 98 wt %) were prepared and the magnetic permeability μ of each of the samples was measured. As a metal magnetic powder, one obtained by mixing a first metal magnetic powder (permalloy) and a second metal magnetic powder (carbonyl iron) in a weight ratio of 75/25 was used.

It is to be noted that as a sample, a molded toroidal core having an outer diameter of 15 mm, an inner diameter of 9 mm, and a height of 3 mm was used, and 20 turns of a 0.70 mmϕ (coating thickness: 0.15 mm) copper wire were wound around the toroidal core to measure magnetic permeability at room temperature, 0.4 A/m, 0.5 mA, and 100 kHz.

FIG. 13 is a graph showing the measurement results, in which a horizontal axis represents the metal magnetic powder content and a vertical axis represents the magnetic permeability μ.

As is clear from the graph shown in FIG. 13, the magnetic permeability μ is particularly high when the metal magnetic powder content is 97 wt % or higher, from which it is found that particularly high magnetic permeability is achieved when the metal magnetic powder content is 97 wt % or higher.

Figure 14:
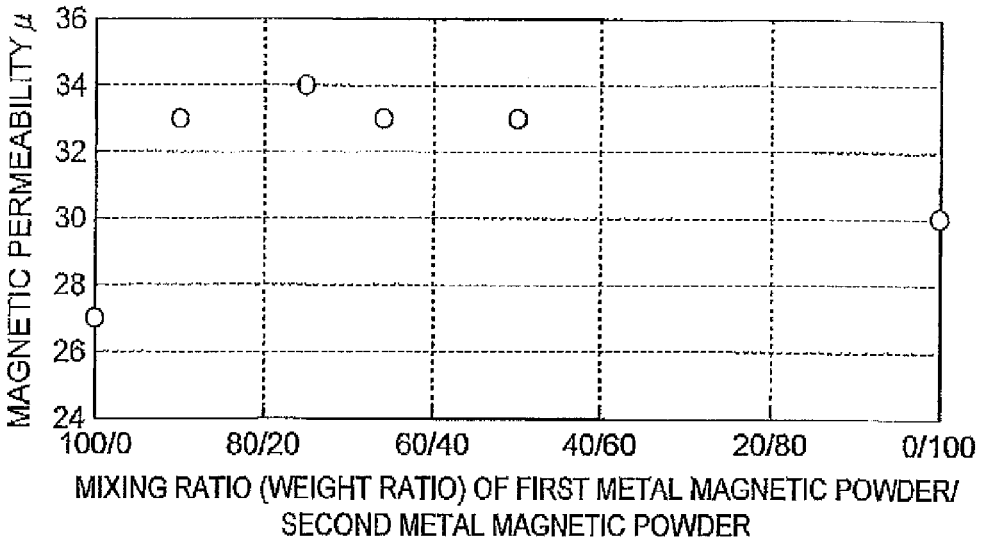
FIGS. 14A and 14B are a graph and a table showing the results of an experiment on the mixing ratio between a first metal magnetic powder and a second metal magnetic powder, respectively.

(Mixing Ratio between First Metal Magnetic Powder and Second Metal Magnetic Powder) FIGS. 14A and 14B show the results of an experiment performed by the present inventors to determine an appropriate mixing ratio between the first metal magnetic powder and the second metal magnetic powder. In this experiment, the amount of metal magnetic powder contained in the metal magnetic powder-containing resin was set to 97 wt %, and six kinds of samples different in mixing ratio between the first metal magnetic powder and the second metal magnetic powder were prepared and the magnetic permeability μ of each of the samples was measured.

FIG. 14A is a graph showing the measurement results, in which a horizontal axis represents the mixing ratio by weight between the first metal magnetic powder and the second metal magnetic powder and a vertical axis represents the magnetic permeability μ. FIG. 14B shows the measurement results in tabular form.

It is to be noted that as a sample, a molded toroidal core having an outer diameter of 15 mm, an inner diameter of 9 mm, and a height of 3 mm was used, and 20 turns of a 0.70 mmϕ (coating thickness: 0.15 mm) copper wire were wound around the toroidal core to measure magnetic permeability at room temperature, 0.4 A/m, 0.5 mA, and 100 kHz.

As is clear from the measurement results shown in FIGS. 14A and 14B, the magnetic permeability μ is high when the weight ratio between the first metal magnetic powder and the second metal magnetic powder is in the range of 90/10 to 50/50. The reason for this is considered to be that the filling factor of metal magnetic powder was increased.

(Average Particle Size Ratio between First Metal Magnetic Powder and Second Metal Magnetic Powder) FIG. 15 shows the results of an experiment performed by the present inventors to determine an appropriate average particle size ratio between the first metal magnetic powder and the second metal magnetic powder. In this experiment, the amount of metal magnetic powder contained in the metal magnetic powder-containing resin was set to 97 wt %, and three kinds of samples (Sample A, Sample B, and Sample C) different in average particle size ratio between the first metal magnetic powder and the second metal magnetic powder were prepared and the magnetic permeability μ of each of the samples was measured.

The three kinds of samples were as follows: Sample A having an average particle size ratio of 1/32 (the average particle size of a permalloy powder as the first metal magnetic powder was 32 atm and the average particle size of a carbonyl iron powder as the second metal magnetic powder was 1 μm); Sample B having an average particle size ratio of 1/8 (the average particle size of a permalloy powder as the first metal magnetic powder was 32 μm and the average particle size of a carbonyl iron powder as the second metal magnetic powder was 4 μm); and Sample C having an average particle size ratio of 4.6/1 (the average particle size of a permalloy powder as the first metal magnetic powder was 32 μm and the average particle size of a carbonyl iron powder as the second metal magnetic powder was 7 μm). It is to be noted that in the cases of all the samples, the mixing ratio by weight between the first metal magnetic powder and the second metal magnetic powder was set to 75/25.

FIG. 15 is a table showing the measurement results, in which the magnetic permeability μ of each of the samples is shown in the last column.

As is clear from the table shown in FIG. 15, Sample A having an average particle size ratio of 1/32 and Sample B having an average particle size ratio of 1/8 have high magnetic permeability μ, from which it is found that high magnetic permeability is achieved when the ratio of the average particle size of the second metal magnetic powder to the average particle size of the first metal magnetic powder is in the range of 1/32 to 1/8.

It is to be noted that the present invention is not limited to the above-described embodiment, and various changes may be made.

For example, a constituent material of the first metal magnetic powder may be an amorphous, an FeSiCr-based alloy, Sendust, or the like instead of an iron-nickel alloy (permalloy). Further, unlike the above embodiment in which the conductor patterns for planar coil are provided on both upper and lower sides of the substrate, the conductor pattern for planar coil may be provided on only one of the upper and lower sides of the substrate.

What is claimed is:

1. A planar coil element comprising:

a coil unit including a substrate and a conductor pattern for planar coil provided on the substrate, the coil unit having a through hole in a magnetic core;

a metal magnetic powder-containing resin that integrally covers the coil unit on both surface sides of the substrate and fills the through hole of the coil unit; and an oblate or needle-like first metal magnetic powder contained in the metal magnetic powder-containing resin, wherein a quantitative ratio of inclined particles, whose major axes are inclined with respect to a thickness direction and a planar direction of the substrate, to total particles of the first metal magnetic powder contained in the metal magnetic powder-containing resin provided in the through hole, is higher than a quantitative ratio of inclined particles, whose major axes are inclined with respect to the thickness direction and the planar direction of the substrate, to total particles of the first metal magnetic powder contained in the metal magnetic powder-containing resin provided in other than the through hole.

2. The planar coil element according to claim 1, wherein the first metal magnetic powder has an average aspect ratio of 2.0 to 3.2.

3. The planar coil element according to claim 1, further comprising a second metal magnetic powder contained in the metal magnetic powder-containing resin and having an average particle size smaller than an average particle size of the first metal magnetic powder.

4. The planar coil element according to claim 3, wherein the metal magnetic powder-containing resin contains the first metal magnetic powder and the second metal magnetic powder in an amount of 90 to 98 wt %.

5. The planar coil element according to claim 3, wherein a mixing ratio by weight between the first metal magnetic powder and the second metal magnetic powder is 90/10 to 50/50.

6. The planar coil element according to claim 3, wherein a ratio of the average particle size of the second metal magnetic powder to the average particle size of the first metal magnetic powder is 1/32 to 1/8.

* * * * *